US007487968B2

(12) United States Patent
Landwehr

(10) Patent No.: US 7,487,968 B2
(45) Date of Patent: Feb. 10, 2009

(54) STACKER BELT WITH ENGAGEABLE DEPOSIT BOXES

(75) Inventor: Martin Landwehr, Paderborn (DE)

(73) Assignee: Wincor Nixdorf International GmbH, Paderborn (DE)

( * ) Notice: Subject to any disclaimer, the term of this patent is extended or adjusted under 35 U.S.C. 154(b) by 517 days.

(21) Appl. No.: 10/489,905

(22) PCT Filed: Aug. 7, 2002

(86) PCT No.: PCT/DE02/02894

§ 371 (c)(1),
(2), (4) Date: Sep. 24, 2004

(87) PCT Pub. No.: WO03/026994

PCT Pub. Date: Apr. 3, 2003

(65) Prior Publication Data

US 2005/0029338 A1 Feb. 10, 2005

(30) Foreign Application Priority Data

Sep. 25, 2001 (DE) ..... 101 47 134

(51) Int. Cl.
*B65H 29/54* (2006.01)

(52) U.S. Cl. ..... 271/312; 271/300; 271/305; 271/308; 271/180; 271/900; 271/277

(58) Field of Classification Search ..... 271/299, 271/300, 303, 305, 298, 296, 297, 307, 308, 271/311–313, 181, 900, 277, 302, 177, 180; 414/790.9, 793.5; 209/534, 583–584, 900
See application file for complete search history.

(56) References Cited

U.S. PATENT DOCUMENTS

| | | | | | |
|---|---|---|---|---|---|
| 2,937,739 | A | * | 5/1960 | Levy | 198/352 |
| 3,129,824 | A | * | 4/1964 | Maurice et al. | 414/790.9 |
| 3,174,749 | A | * | 3/1965 | Childs | 271/204 |
| 3,430,951 | A | * | 3/1969 | Lubor et al. | 271/302 |
| 3,508,648 | A | * | 4/1970 | Stickney | 209/657 |
| 3,717,249 | A | * | 2/1973 | Faley | 209/552 |
| 4,203,590 | A | * | 5/1980 | Blessing | 271/265.01 |
| 5,054,621 | A | | 10/1991 | Murphy et al. | |

(Continued)

FOREIGN PATENT DOCUMENTS

| | | |
|---|---|---|
| DE | 217 701 | 12/1908 |

(Continued)

*Primary Examiner*—Patrick H Mackey
*Assistant Examiner*—Jeremy Severson
(74) *Attorney, Agent, or Firm*—Michaud-Duffy Group LLP

(57) ABSTRACT

The invention relates to a device for depositing notes, which comprises a plurality of storage compartments for depositing the notes, means for transporting the notes to the storage compartments and for the organized deposit of the same on stacks disposed in the storage compartments. The inventive device comprises one or more parallel revolving belts on which fingers are successively disposed in the longitudinal direction which cooperate with the belts to give receiving pockets for the notes. Every storage compartment is associated with a respective stripping element interposed between the storage compartment and the belts. For depositing a note in the storage compartment the belts and/or the corresponding stripping element can be adjusted relative each other in such a manner that the stripping element projects into the path of a note that is displaced by means of the belt.

12 Claims, 6 Drawing Sheets

U.S. PATENT DOCUMENTS

| | | | | |
|---|---|---|---|---|
| 5,575,464 | A * | 11/1996 | Martinez et al. | 271/2 |
| 5,931,459 | A | 8/1999 | Landgren | |
| 6,164,432 | A * | 12/2000 | Monsees | 198/459.4 |
| 2007/0045950 | A1 * | 3/2007 | Dobrindt | 271/303 |

FOREIGN PATENT DOCUMENTS

| | | | |
|---|---|---|---|
| DE | 442 337 | | 3/1927 |
| DE | 442337 | | 3/1927 |
| DE | 677 480 | | 6/1939 |
| DE | 195 22 998 | C2 | 1/1997 |
| DE | 197 57 421 | A1 | 7/1999 |
| DE | 198 10 928 | A1 | 9/1999 |
| EP | 0 841 643 | A1 | 5/1998 |
| GB | 1 174 457 | A | 12/1969 |
| GB | 2 324 521 | A | 10/1998 |

* cited by examiner

STACKER BELT WITH ENGAGEABLE DEPOSIT BOXES

CROSS-REFERENCE TO RELATED APPLICATIONS

This application is entitled to the benefit of and incorporates by reference essential subject matter disclosed in International Application No. PCT/DE02/02894 filed on Aug. 7, 2002 and German Patent Application No. 101 47 134.3 filed on Sep. 25, 2001.

FIELD OF THE INVENTION

The invention relates to a device for depositing notes, the device comprises a plurality of storage compartments for depositing the notes and means for conveying the notes to the storage compartments and for the organized depositing of the same on stacks situated in the storage compartments.

BACKGROUND OF THE INVENTION

Devices of this type are known, for example, from customer terminals for depositing banknotes or checks, such as are provided by credit institutions. It is extremely advantageous for the operator of such customer terminals if the deposited notes are automatically distributed according to sort to the different storage compartments where they are deposited in organized stacks. Organized and sorted depositing is required in particular if the deposited notes are to be further processed mechanically, for example are to be counted or paid out again. In addition, depositing on stacks affords the advantage that the deposited notes require less space than notes dumped in an uncontrolled manner, and the storage compartments can therefore be kept smaller and do not have to be emptied as often.

A stacking device for notes is disclosed in DE 197 57 421 A1. Said device comprises a rotatable stacking wheel having a multiplicity of fingers whose one end is fastened to the circumference of the stacking wheel and between which a receiving pocket for notes is formed in each case. Depending on the angular position of the stacking wheel, this receiving pocket is open or closed. Thus, in an angular region with an open receiving pocket, notes can be introduced into the stacking wheel, can be moved by the stacking wheel through an angular region with a closed receiving pocket, and finally, in a further angular region with an open receiving pocket, can be deposited on a stack.

A stacking wheel of this type deposits all of the notes which have been introduced on the same stack. For the device of the type mentioned at the beginning, an associated stacking wheel would be required for each storage compartment and, in addition, a transporting mechanism having switches or the like, with which the deposited note is supplied to the corresponding stacking wheel. Such a construction would be complicated, expensive and would also require a lot of space.

SUMMARY OF THE INVENTION

The invention is based on the object of specifying a device of the type mentioned at the beginning, the device bringing about the specific transportation to one of several storage compartments available for selection and the organized depositing on stacks in a simple, cost-effective and space-saving manner.

This object is achieved with a device of the type mentioned at the beginning by the fact that it has one or more parallel, revolving belts on which fingers are arranged successively in the longitudinal direction of the belts, said fingers cooperating with the belts to form receiving pockets for the notes, that each storage compartment is assigned a stripping element which is arranged in each case between the storage compartment and belt, and that to deposit a note in a selected storage compartment belts and/or the corresponding stripping element can be adjusted relative to one another in such a manner that the stripping element projects into the path of a note moved by the belt. The note which is moved in a receiving pocket by the belt is guided by the stripping element into the box and, in a manner described in greater detail below, comes to a standstill in front of a stack situated in the storage compartment.

In the case of the device according to the invention, notes can therefore be transported by a single belt or by a set of parallel, revolving belts to any desired number of storage compartments where they are deposited in an organized manner in each case on a stack with the aid of a stripping element.

The stripping element can preferably be a stripping plate which has a number of slots corresponding to the number of belts, through which the belts can pass when the stripping element projects into the path of a note moved by the belts.

The fingers are preferably attached at one end to the respective belt in such a manner that, when the belt is stretched out, they bear against the latter and cooperate with it to form a closed receiving pocket, but when the belt is appropriately curved, they protrude from the latter and cooperate with it to form an open receiving pocket. In this respect, a belt of this type is similar to the stacking wheel which has been mentioned, and, in particular, notes can be introduced into its receiving pockets in a manner known per se.

In one preferred embodiment, the belt which has been mentioned is a toothed belt.

The storage compartments preferably abut against the stripping element with a side which is open or is to be opened and are provided in such a manner that the notes can stand upright in them in a stack which extends until immediately in front of the stripping element.

For each storage compartment, there is preferably a switchable deflecting device for deflecting the belt in the direction of the storage compartment in such a manner that the stripping element projects into the path of a note which is moved in a receiving pocket by the belt. In this case, the belt is preferably deflected in such a manner that the fingers forming the receiving pocket push the stack of notes situated in the storage compartment into the storage compartment, and a note situated in the receiving pocket is guided by the stripping element into the storage compartment, adheres to the floor of the storage compartment and comes to a standstill in front of the stack.

Furthermore, the deflecting device is preferably designed and arranged in such a manner that the receiving pocket is opened as it passes the stripping element by virtue of the curvature of the belt caused when the latter is deflected. The note is thereby released and can be slowed down in a gentle manner.

In one preferred embodiment, the deflecting device has a number of deflection rollers corresponding to the number of belts, said deflection rollers being arranged opposite the stripping element on the other side of the belt and being adjustable for deflection in the direction of the stripping element.

In a further preferred embodiment, the deflecting device contains guide elements with the aid of which sliding elements fastened to the belt can be guided in order to deflect the belt. In one particularly advantageous variant, the guide elements are formed by the longitudinal edges of the slots in the respective stripping plate, and as sliding elements at that end of each finger which is fixed on the belt two sliding blocks are attached on opposite sides of the finger, and on their respective side which faces away from the finger a receptacle for the longitudinal edge is formed in such a manner that the sliding blocks can be guided in a sliding manner along the longitudinal edges. A deflecting device of this type is particularly simple in construction.

In a further preferred embodiment, the stripping plate can be adjusted in the direction of the belts until it projects into the path of a note moved by the belt.

BRIEF DESCRIPTION OF THE DRAWINGS

Further advantages and features of the solution according to the invention emerge from the following description which explains the invention with reference to an exemplary embodiment in conjunction with the attached drawings, in which.

DETAILED DESCRIPTION OF THE PREFERRED EMBODIMENTS

Figure 1:
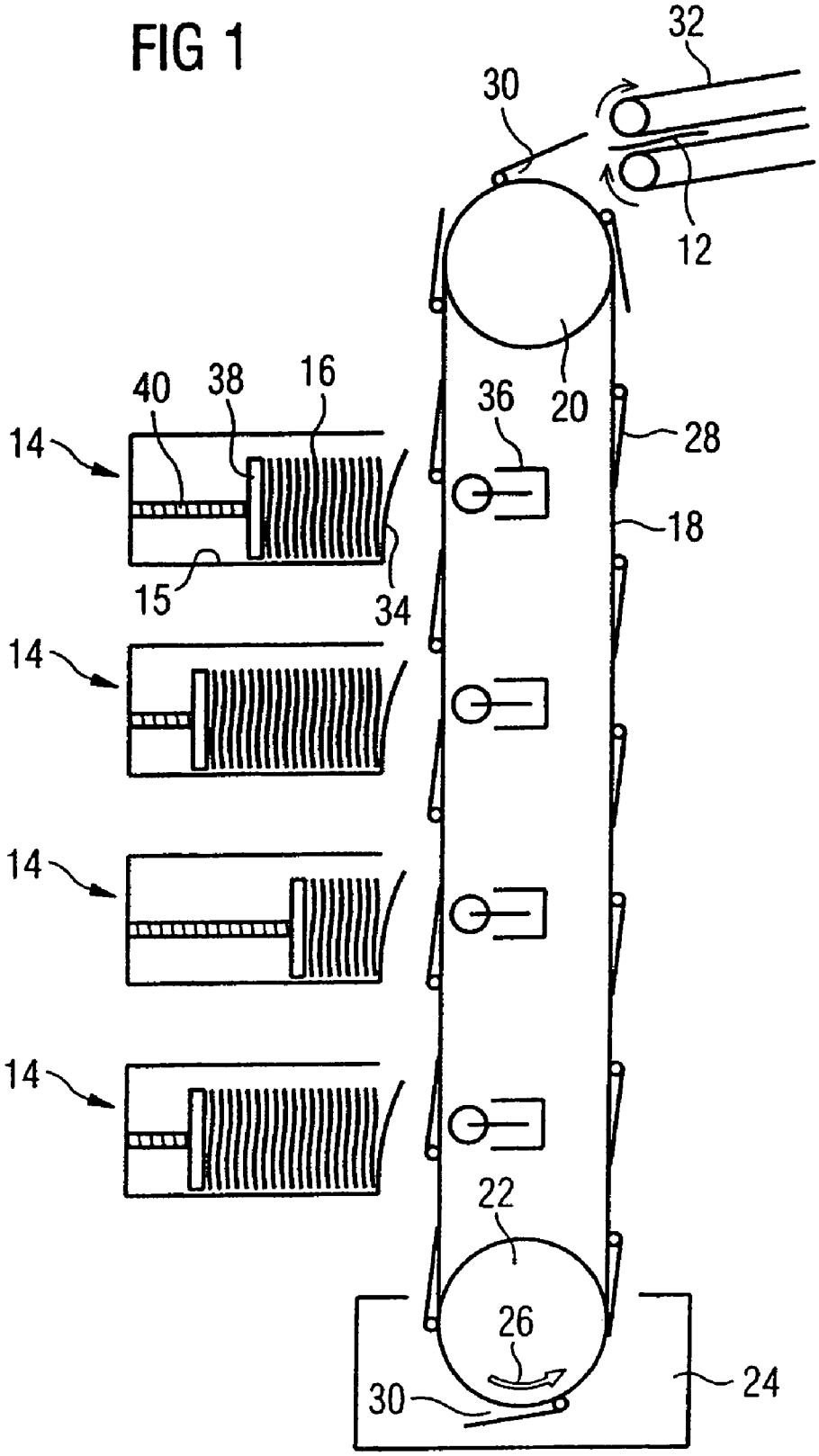
FIG. 1 shows the device according to the invention in a simplified illustration in side view.

FIG. 1 shows a device 10 according to the invention for depositing notes, in which a deposited note 12 can be deposited in an organized manner in one of a number of available storage compartments 14. The storage compartments 14 are designed as removable storage boxes which are arranged vertically one above another and in which notes which have already been deposited stand upright in stacks 16.

The device according to the invention contains two mutually parallel, revolving toothed belts 18 which are situated one above the other in the perspective of FIG. 1, so that only one of them can be seen. The revolving pair of belts 18 is clamped between an upper gearwheel 20 and a lower gearwheel 22. In this case, the pair of belts 18 is guided with its outside at the same distance past all of the storage boxes 14. The upper gearwheel 20 or lower gearwheel 22 is driven by a motor 24 and rotates in this case in the direction indicated by the arrow 26.

A multiplicity of fingers 28 are arranged successively in the longitudinal direction of the belts on the outsides of the belts 18. The fingers 28 are attached to the belts 18 in such a manner that, when the belts are stretched out, they bear against the latter and cooperate with them to form a closed receiving pocket for notes. A closed received pocket of this type is illustrated in FIG. 2*a*.

Figure 2A:
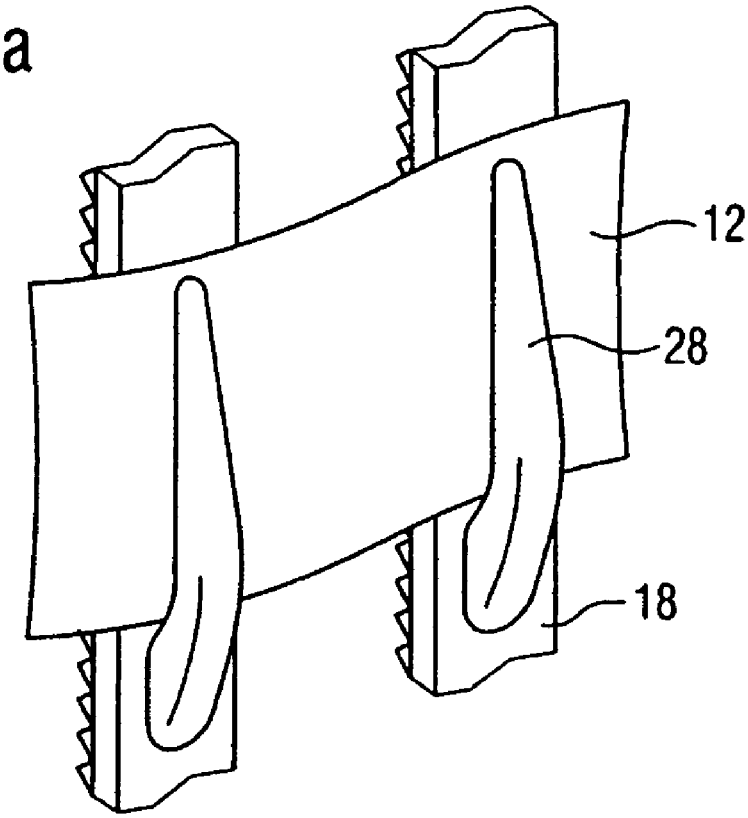
FIG. 2*a* shows a perspective drawing of a note in a receiving pocket formed by two parallel belts and two fingers injection molded on them.

In FIG. 2*a*, the fingers are made of the same material as the belt and are injection molded onto it. The belt and fingers therefore form a single part. As an alternative, the fingers, however, can be fastened at one end to the belt in a pivotable manner via a mandrel 50 and can be clamped by the shaping of the mounts 52 for the mandrel or a spring (not shown) in such a manner that, when the belt is stretched out, they bear against it.

However, when the belt is appropriately curved in the region of the finger, the latter protrudes from the belt and cooperates with it to form an open receiving pocket. Two such open receiving pockets 30 can be seen in FIG. 1 at the point at which the pair of belts 18 is deflected by the gearwheels 20 and 22 and is thereby curved. A deposited note 12 can be placed into one such open receiving pocket 30 in a manner known per se, for example, by the note 12, as illustrated in FIG. 1, being shot into the open receiving pocket 30 with the aid of known transporting belts 32. After the belt section forming the receiving pocket has passed the upper gearwheel 20, the receiving pocket closes and the note is reliably transported in the closed receiving pocket to the storage compartment provided.

In FIG. 1, the storage boxes 14 are open on their side which faces the belts. A stripping element 34 which is arranged between the pair of belts 18 and storage box 14 is attached to each storage box 14. Furthermore, each storage box 14 is assigned a deflecting device 36 which is situated opposite the stripping element 34 on the other side of the pair of belts 18. The stripping element 34 and deflecting device 36 serve for the organized depositing of the notes in the associated storage compartment 14, and their operation will be explained in greater detail below.

The device according to the invention is accordingly constructed in such a manner that a single pair of belts guides the deposited note 12 in a closed receiving pocket past all of the available storage compartments 14, and the note is removed from the receiving pocket at the selected storage compartment with the aid of the stripping element 34 and the deflecting device 36 and is deposited in an organized manner in the storage compartment 14. This construction is space-saving and simple in comparison with a conventional construction in which there is an individual transporting path to each storage compartment.

Figure 3:
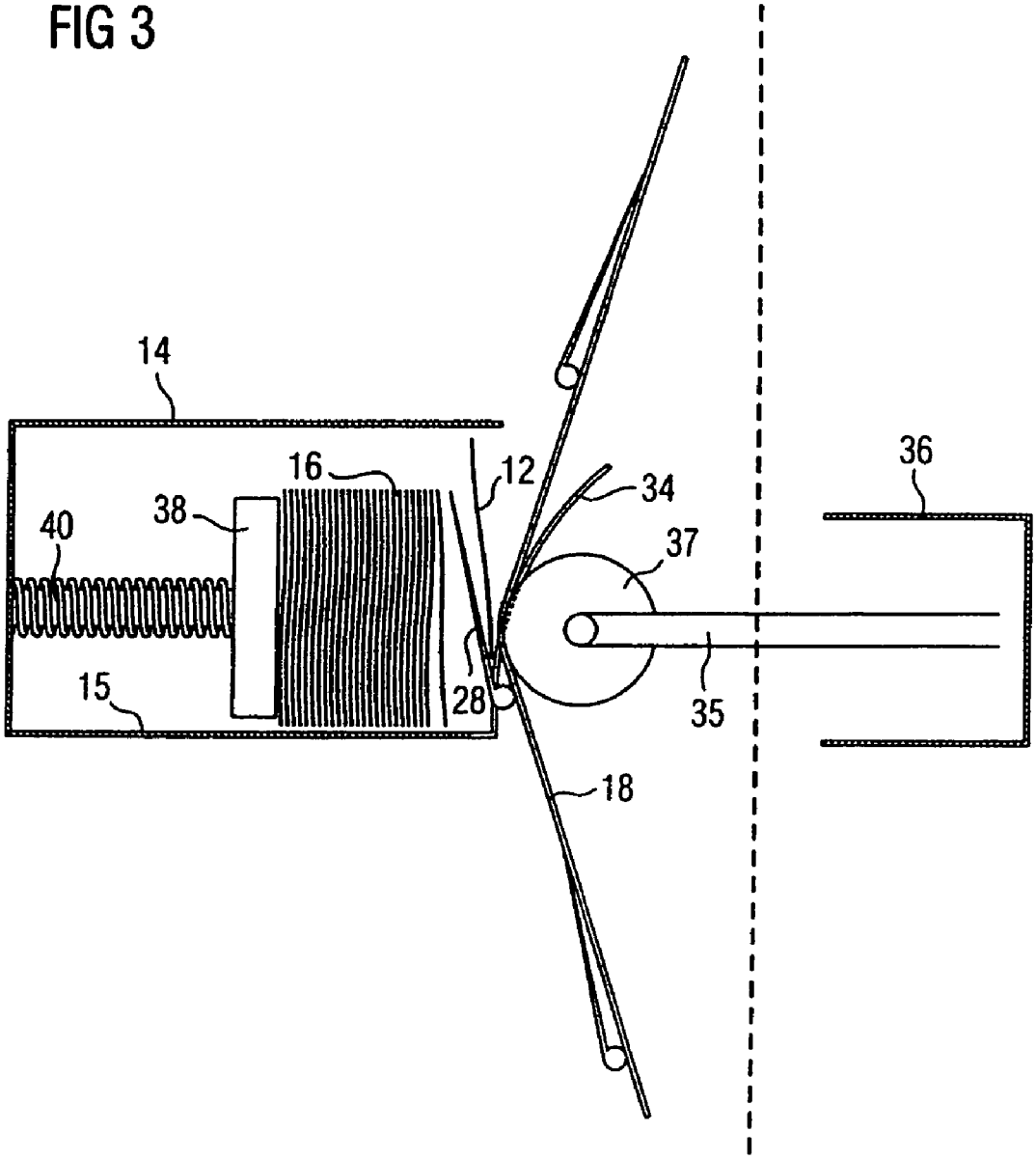
FIG. 3 shows a side view of a storage box with an associated stripping element and deflecting device during the depositing of a note.

With reference to FIG. 3, the manner in which the device according to the invention is able to remove the note 12 from a receiving pocket and deposit it in an organized manner on the stack 16 in the storage box 14 selected for the note 12 will be explained. FIG. 3 shows this storage box 14 and the associated switchable deflecting device 36, with a pair of deflection rollers 37, which is adjusted in the direction of the stripping element 34 with the aid of an adjusting device 35 and in the process deflects the pair of belts 18. This corresponds to the activated state of the deflecting device. The adjusting device 35 can be operated by a stepping motor or lifting magnet (neither shown). The plane in which the stretched-out belt 18 is situated if the deflecting device is not activated is indicated in FIG. 3 by the dashed line.

The stripping element 34 is designed here as a stripping plate having two parallel slots 19 (not visible in the view of FIG. 3) through the pair of belts 18 and pair of deflection rollers 37 pass when the deflection which is shown has taken place. A stripping plate 34 with slots 19 is shown in FIG. 4*b*.

The deflection of the pair of belts 18 in the region of the storage box 14 has two consequences. Firstly, it causes the stripping plate 34 to project into the path of the note 12 moved by the belt, so that said note is guided by the stripping plate 34 into the storage box 14. Secondly, the pair of belts is curved by the deflection in such a manner that the fingers 28 forming the receiving pocket protrude from the pair of belts 18 and thereby press the stack 16 into the storage box 14 and at the same time release the carried-along note 12. The released note 12 adheres to the floor 15 of the storage box 14 and comes to stand in front of the stack 16 of upright notes.

The mechanism described causes the stack 16 to grow to the left in FIG. 3. A wall 38 bounding the stack 16 on the left therefore has to be successively displaced to the left to the same extent as notes are deposited in the storage compartment. Use is made for this purpose of an adjusting mechanism 40 which can be designed, for example, as a screw which is rotated by a stepping motor (not shown) and in the process displaces the left side wall 38 to the left.

In an alternative embodiment, the pair of belts 18 is deflected by sliding elements 60 which are attached to the fingers 28 being guided in a sliding manner along guide elements 21. In the following exemplary embodiment, the sliding elements 60 are sliding blocks, two of which are assigned to each finger, and the guide elements 21 are formed by the longitudinal edges of the slots 19 of the stripping plate 34. (see FIGS. 4*a* and 4*b*).

Figure 2B:
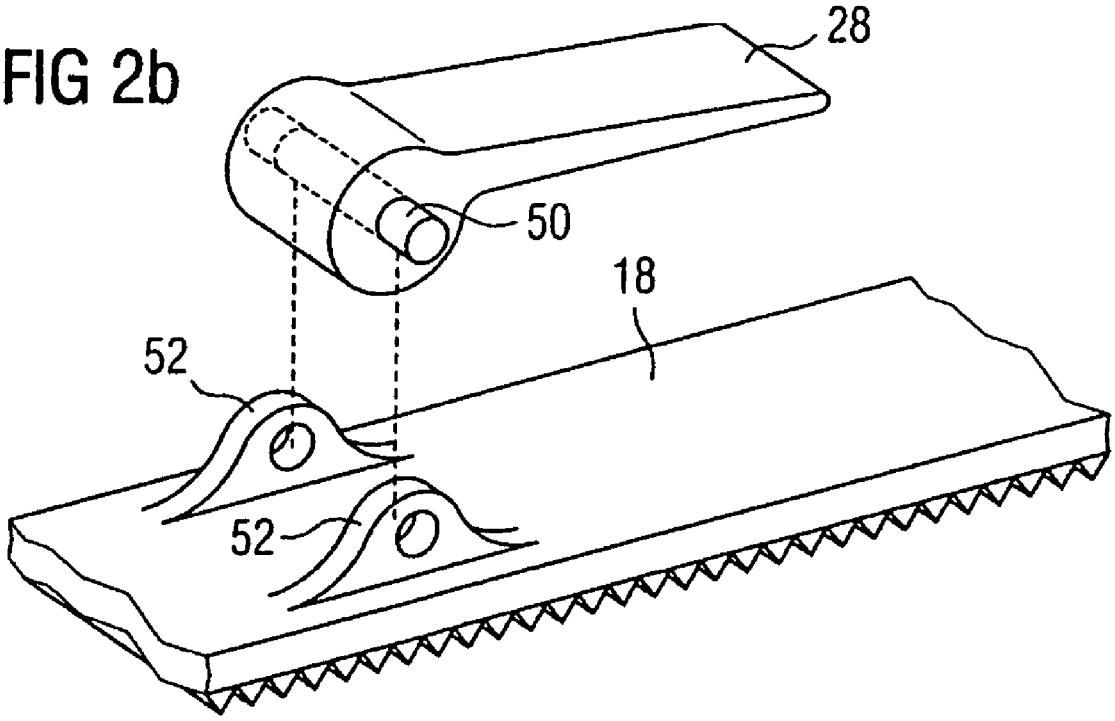
FIG. 2*b* shows a fastening device for separately produced fingers on the belt.
Figure 4A:
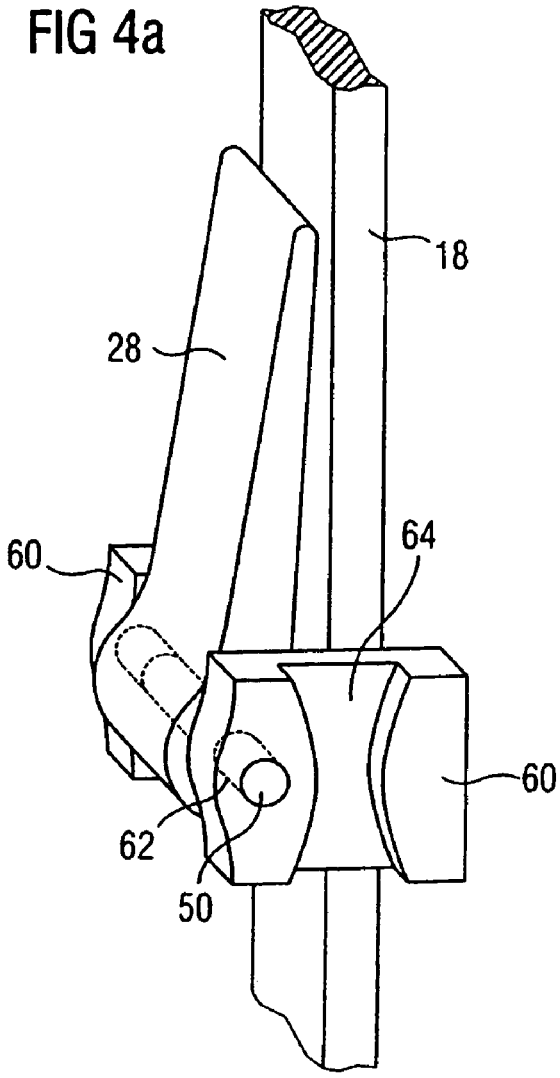
FIG. 4*a* shows a perspective drawing of a finger, belt and sliding block.
Figure 4B:
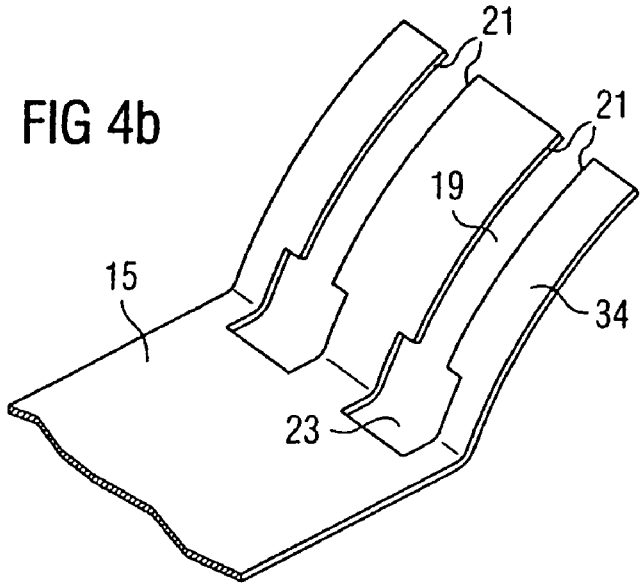
FIG. 4*b* shows a perspective drawing of the stripping plate and floor of a storage box.

As can be seen in FIG. 4*a*, the sliding blocks 60 are fastened on opposite sides of the finger 18 with the aid of the extended mandrel 50 of FIG. 2*b*, which is introduced for this purpose into a hole 62 in the sliding block 60. The sliding block has, on its side facing away from the finger, a receptacle 64 for the longitudinal edge 21. To deflect the belt 18, the two longitudinal edges 21 of a slot 19 are introduced into the respective receptacles 64 of two sliding blocks 60 belonging to a finger 28, and the sliding blocks slide along the longitudinal edges 21. In this case, the deflection of the belt is governed by the shape of the stripping plate 34.

Figure 4C:
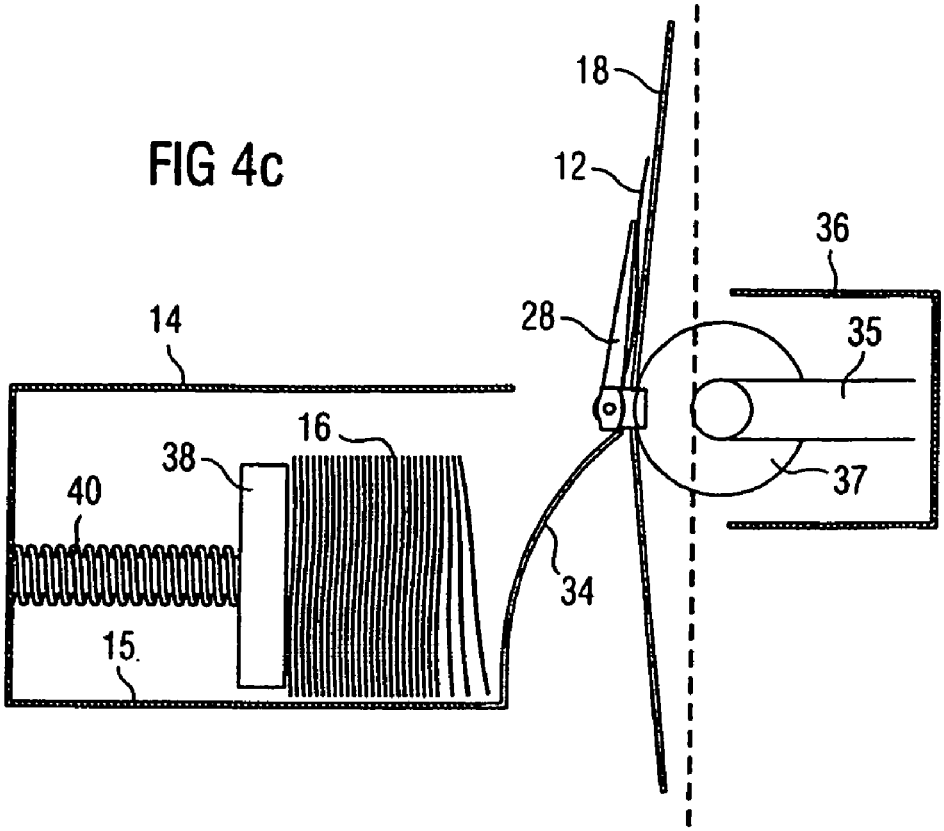
FIGS. 4*c*, 4*d* show two consecutive snapshots of a detail of the device according to the invention during the depositing of a note, in which the belts are deflected with the aid of guide and sliding elements.

In order to introduce the longitudinal edges 21 into the receptacles 64, it is possible, for example, for the belt 18 to be deflected to such an extent that the sliding blocks 60 just come into contact with the upper edge of the stripping plate 34. Such a situation is shown in FIG. 4*c*. As in FIG. 3, the pair of belts 18 may be deflected for this purpose by a pair of deflection rollers 37 adjusted in the direction of the stripping plate 34, but this deflection is initially much smaller than the deflection in FIG. 3. The longitudinal edges 21 are inserted here in the receptacles 64 of the sliding blocks 60, and the latter slides along the longitudinal edges 21.

Figure 4D:
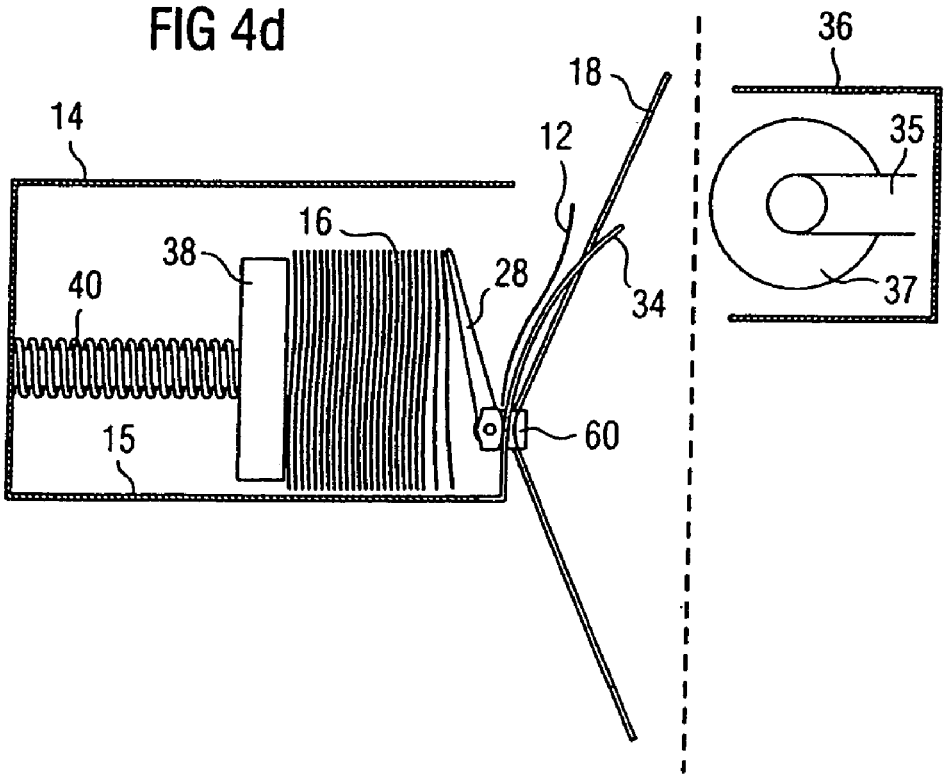

The effect achieved by the sliding blocks 60 following the longitudinal edges 21 is that the pair of belts 18 is then deflected to a similar extent as in FIG. 3, in which case, as there, the fingers 28 protrude from the belt 18, so that a receiving pocket with the note 12 contained in it opens and the stack 16 of notes situated in the storage box 14 is pressed into the storage box by the protruding finger (FIG. 4*d*). The depositing of the note takes place in the manner described in conjunction with FIG. 3.

Directly above the floor 15 of the storage box 14 the slots 19 merge into wider sections 23. On reaching the wide section 23, the sliding blocks 60 leave the guide formed by the longitudinal edges 21, so that the belts 18 resume the stretched-out position.

A deflecting device having guide and sliding elements has the advantage that a small adjustment of the belt 18 and/or stripping plate 34 is sufficient in order to bring guide and sliding elements into engagement with one another and therefore to initiate the deflection. Use can therefore be made of relatively small adjusting devices 35, which cause lower costs and require less space. In addition, the deflection can be optimized in respect of a reliable, organized depositing of the note 12 by the shaping of the stripping plate 34.

Figure 5A:
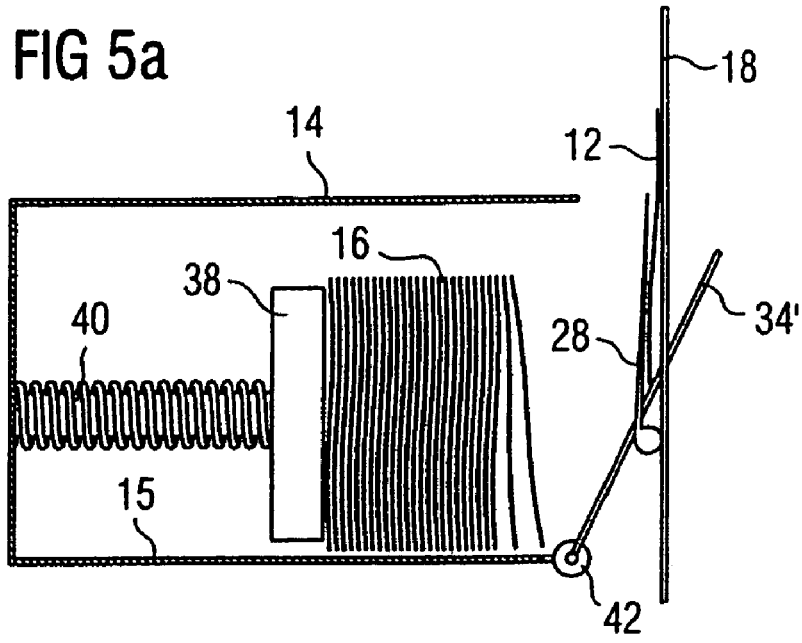
FIGS. 5*a*, 5*b* show two consecutive snapshots of a detail of the device according to the invention during the depositing of a note with the aid of an adjustable stripping plate.
Figure 5B:
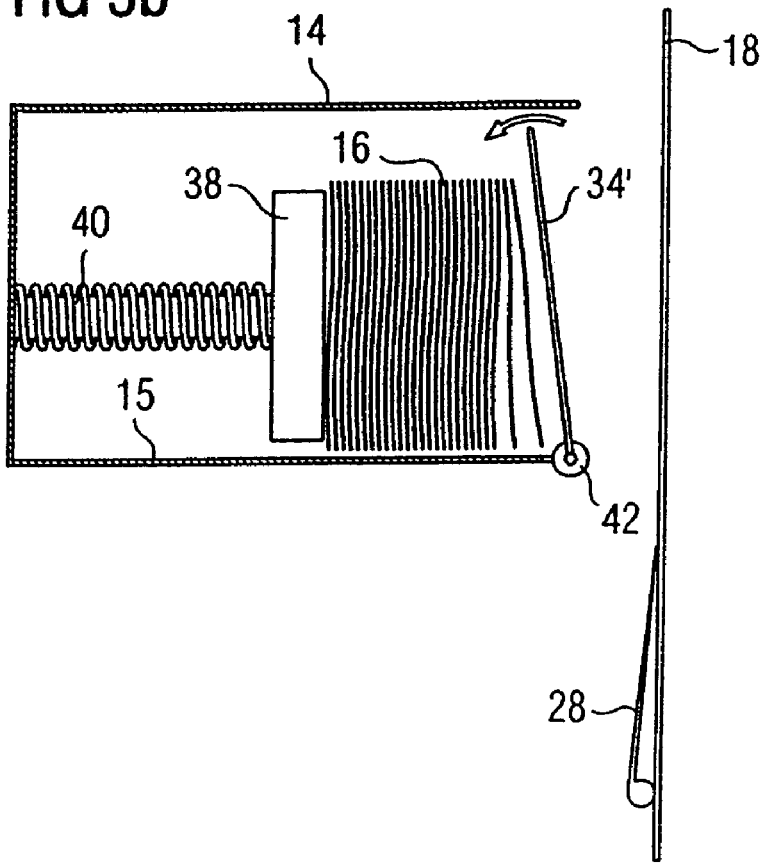

FIGS. 5*a* and 5*b* show a further embodiment in which a stripping plate 34' can be pivoted about an axis 42 in the direction of the pair of belts 18 until it projects into the path of a note moved by the belts. This situation is shown in FIG. 5*a*, in which the pair of belts 18 is not deflected. The stripping plate 34' likewise has two parallel slots through which the pair of belts 18 in FIG. 5*a* passes whereas the note 12 adheres to the stripping plate 34'. As a result, the note 12 is removed from the receiving pocket. The stripping plate 34' can then be pivoted about the axis 42 in the direction of the stack 16, as a result of which the note 12 which has been removed is placed onto the stack 16 (FIG. 5*b*).

In the embodiment illustrated in FIGS. 5*a* and 5*b*, the adjustable stripping plate 34' renders a deflecting device superfluous. However, a construction is also possible in which a pivotable stripping plate and a deflecting device are used in combination.

In particular, a pivotable stripping plate 34' can advantageously be combined with a deflecting device having guide and sliding elements. Instead of, as in FIG. 4*c*, moving the belts 18 toward the stripping plate 34, a pivotable stripping plate 34' may, for example, be adjusted to such an extent in the direction of the pair of belts 18 that the sliding blocks 60 make contact with the upper edge of the stripping plate 34' and in the process the longitudinal edges of their slots 19 are introduced into the receptacles 64 of the sliding blocks.

The invention claimed is:

1. A device for depositing notes, which comprises:

a plurality of storage compartments for depositing the notes, and means for conveying the notes to the storage compartments and for the organized depositing of the notes on stacks situated in the storage compartments, characterized in that the conveying means has one or more parallel, revolving belts on which fingers are arranged successively in the longitudinal direction of the belts, said fingers cooperating with the belts to form receiving pockets for the notes, in that each storage compartment is assigned a stripping element which is arranged in each case between the storage compartment and belt, and in that to deposit a note in a selected storage compartment, a deflecting device is activated to urge the belt in the direction of the stripping element of the selected storage compartment such that the stripping element projects into the path of a note moved by the belt.

2. The device as claimed in claim 1, wherein the stripping element is a stripping plate which has a number of slots corresponding to the number of belts, through which the belts can pass when the stripping element projects into the path of a note moved by the belts.

3. The device as claimed in claim 2, wherein guide elements are formed by the longitudinal edges of the slots of the stripping plate, and wherein sliding elements at the end of each finger fixed on the belt comprise two sliding blocks attached on opposite sides of the finger, and on their respective side which faces away from the finger a receptacle for the longitudinal edge is formed in such a manner that the sliding blocks can be guided in a sliding manner along the longitudinal edges.

4. The device as claimed in claim 1, wherein the fingers are attached at one end to the respective belt in such a manner that, when the belt is stretched out, the fingers bear against the belt and cooperate with it to form a closed receiving pocket, but when the belt is appropriately curved, the fingers protrude from the belt and cooperate with it to form an open receiving pocket.

5. The device as claimed in claim 4, wherein the deflecting device is designed and arranged in such a manner that the receiving pocket is opened as it passes the stripping element by virtue of the curvature of the belt caused when the belt is deflected.

6. The device as claimed in claim 1, wherein the belt is a toothed belt.

7. The device as claimed in claim 1, wherein the storage compartments abut against the stripping element with a side which is open or is to be opened and are provided in such a manner that the notes can stand upright in the storage compartments in a stack which extends until immediately in front of the stripping element.

8. The device as claimed in claim 1, wherein the deflecting device is designed and arranged in such a manner that the fingers forming the receiving pocket, when they are deflected, push the stack of notes situated in the associated storage compartment into the storage compartment, and a note situated in the receiving pocket is guided by the stripping element into the storage compartment, adheres to the floor of the storage compartment and comes to a standstill in front of the stack.

9. The device as claimed in claim 1, wherein the deflecting device has a number of deflection rollers corresponding to the number of belts, said deflection rollers being arranged opposite the stripping element on the other side of the belt and being adjustable for deflection in the direction of the stripping element.

10. The device as claimed in claim 1, wherein the deflecting device, guide elements of the stripping plate and sliding elements fastened to the belt cooperate such that the sliding elements can be guided in order to deflect the belt.

11. The device as claimed in claim 1, wherein the stripping plate can be adjusted in the direction of the belts until it projects into the path of a note moved by the belt.

12. A device for depositing notes, which comprises a plurality of storage compartments for depositing the notes, and means for conveying the notes to the storage compartments and for the organized depositing of the notes on stacks situated in the storage compartments, said device comprising:

conveying means having one or more parallel, revolving belts;

fingers arranged successively on said conveying means in the longitudinal direction of said belts, said fingers cooperating with said belts to form receiving pockets for the notes; and a stripping element assigned to each storage compartment, said stripping element arranged in each case between the storage compartment and said belt, and in that to deposit a note in a selected storage compartment at least one of said belt and said corresponding stripping element can be adjusted relative to one another in such a manner that said stripping element projects into the path of a note moved by the belt;

wherein said stripping element is a stripping plate which has a number of slots corresponding to the number of belts through which said belts can pass when the stripping element projects into the path of a note moved by the belts;

wherein guide elements are formed by the longitudinal edges of the slots of the stripping plate; and wherein sliding elements at the end of each finger fixed on said belt comprise two sliding blocks attached on opposite sides of the finger, and on their respective side which faces away from the finger a receptacle for the longitudinal edge is formed in such a manner that the sliding blocks can be guided in a sliding manner along the longitudinal edges.

* * * * *